United States Patent [19]

Seim et al.

[11] 3,945,705

[45] Mar. 23, 1976

[54] WIRE-SPLICING APPARATUS AND CONTACT ELEMENT THEREFOR

[75] Inventors: William J. Seim, St. Paul; Richard D. Kahabka, Village of Burnsville, both of Minn.

[73] Assignee: Minnesota Mining and Manufacturing Company, St. Paul, Minn.

[22] Filed: June 9, 1972

[21] Appl. No.: 261,361

[52] U.S. Cl. ..... 339/98; 339/210 M

[51] Int. Cl.[2] ..... H01R 9/08

[58] Field of Search ..... 339/95, 97–99, 339/210

[56] References Cited

UNITED STATES PATENTS

| | | | |
|---|---|---|---|
| 2,750,572 | 6/1956 | Fox | 339/210 M |
| 3,189,863 | 6/1965 | Leach | 339/17 F |
| 3,414,867 | 12/1968 | Travis | 339/99 R |
| 3,496,522 | 2/1970 | Ellis, Jr. et al. | 339/99 R |
| 3,708,779 | 1/1973 | Enright et al. | 339/99 R |

*Primary Examiner*—Joseph H. McGlynn
*Attorney, Agent, or Firm*—Alexander, Sell, Steldt & DeLaHunt

[57] ABSTRACT

One-piece flat contact element with opposing bifurcate ends and opposing centrally open extended sides makes possible a compact wire-splicing assembly capable of accepting a wide range of wire sizes and offering high dielectric strength.

4 Claims, 8 Drawing Figures

WIRE-SPLICING APPARATUS AND CONTACT ELEMENT THEREFOR

Figure 2:
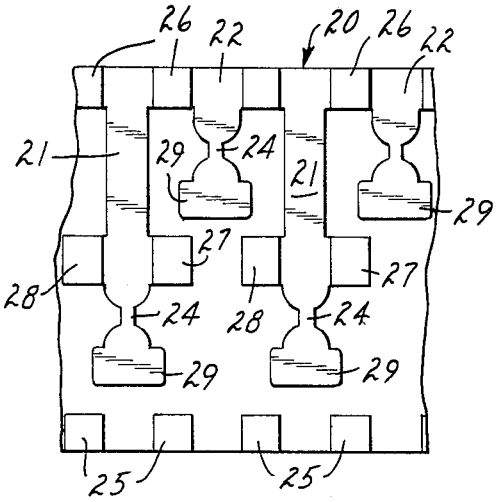

This invention relates to the splicing of communications cables and has particular reference to connector modules wherewith wire-ends of such cables may be electrically connected. In particular, the invention relates to an improvement in modular connectors as described in U.S. Pat. No. 3,708,779 (Ser. No. 91,781 filed Nov. 23, 1970) whereby the thickness and width dimensions of the module are significantly reduced. The invention thus makes possible a highly desirable reduction in the diameter of cable splice assemblies which must frequently be installed in limited-space areas. Size is reduced with no reduction in dielectric strength, and the ability to make spring compression reserve connections to a wide range of wire-sizes is improved.

Figure 3:
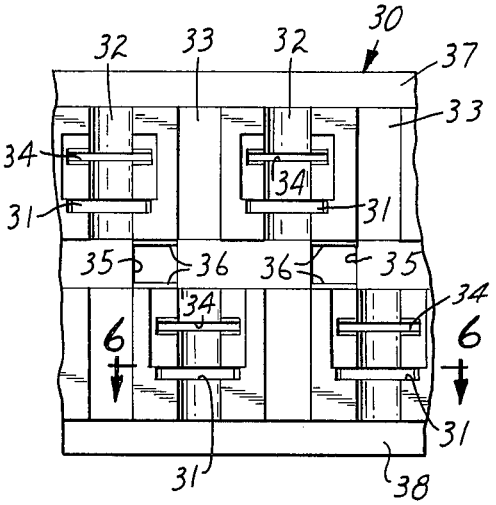
Figure 4:
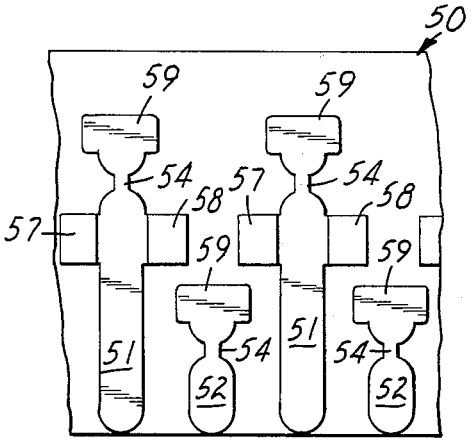
Figure 5:
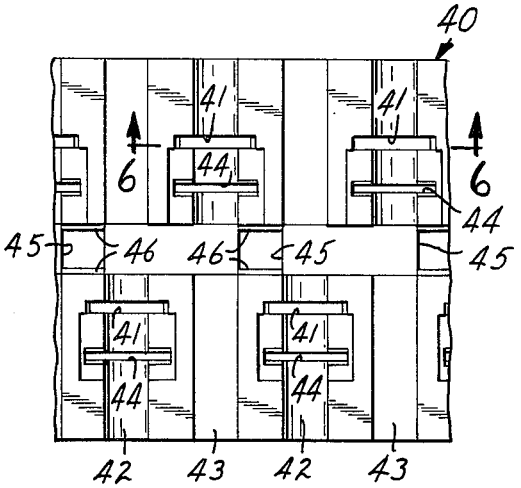
Figure 1:
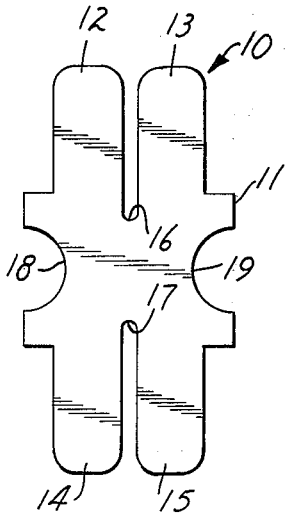
Figure 6:
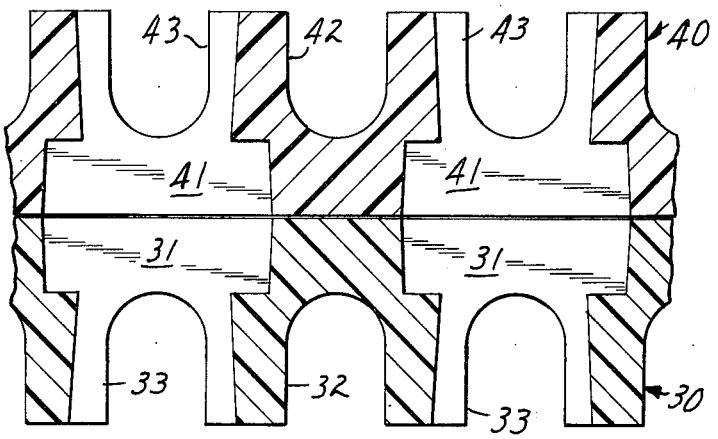
Figure 7:
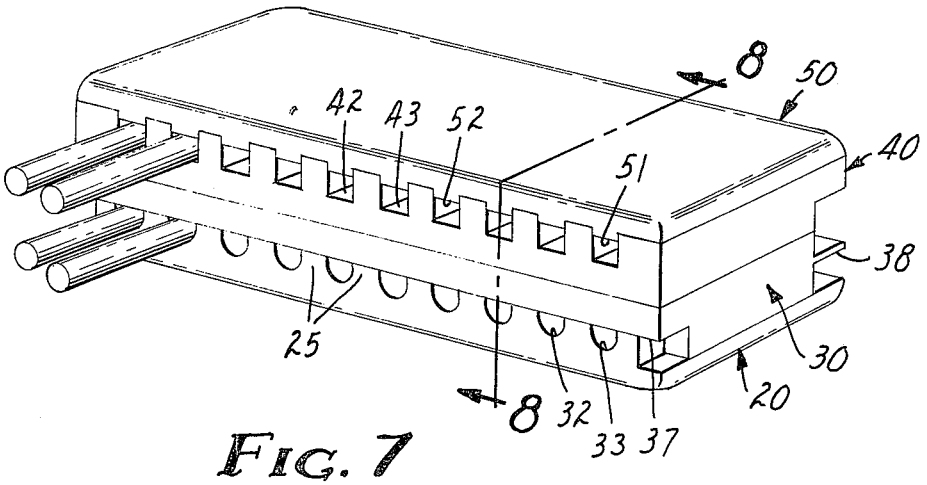
Figure 8:
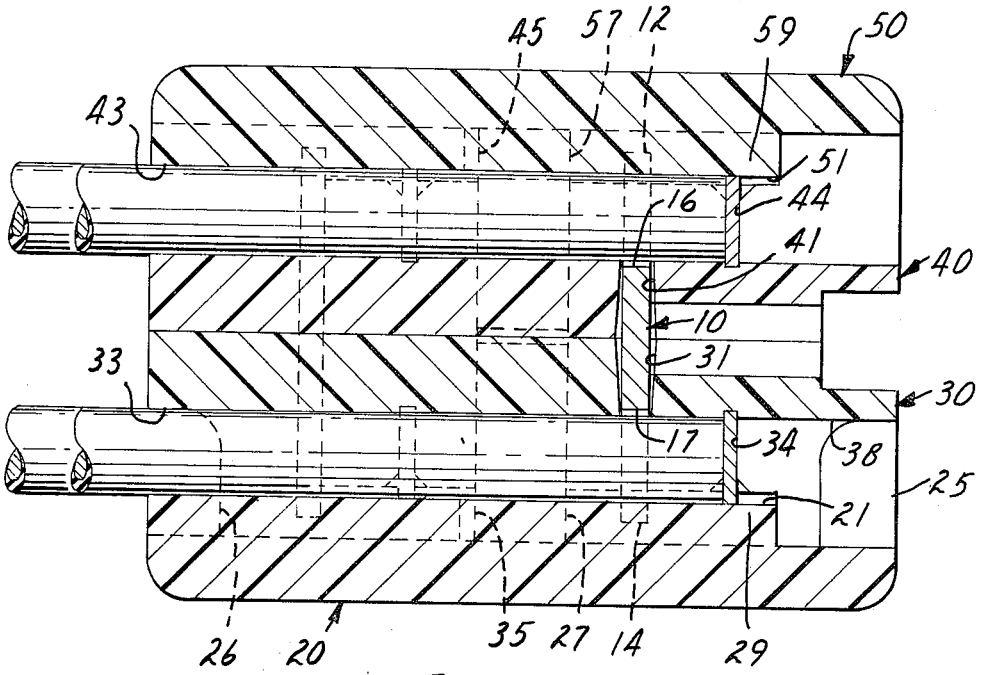

In the drawing,

FIG. 1 is a plan view of a contact element of the invention,

FIGS. 2, 3, 4 and 5 are partial plan views of base, body bottom, body top, and cover members forming the insulating support for the contact elements, FIG. 6 is a sectional view of a portion of the insulating body taken at line 6—6 of FIGS. 3 and 4, FIG. 7 is a perspective view of a connector module of the invention with some wires in place, and FIG. 8 is a sectional view of the connector module of FIG. 7 taken along the line 8—8.

The contact element 10 of FIG. 1 is stamped from a thin flat plate of spring brass or other resilient metal, such for example as 26 gage (0.0159 inch) No. 260 copper alloy having a spring temper of 8 B & S, and is preferably lightly plated with tin or indium metal. Somewhat thinner plate, e.g. down to about 28 gage (0.012 inch) is also useful. The element has an extendedwidth rectangular central portion 11. Legs 12 and 13 extend from one end of the central portion to form an upper bifurcate spring compression reserve contact element, and legs 14 and 15 extend from the other end to form an identical lower contact element. The central slots 16, 17 between the adjacent edges of each pair of legs extend into the central portion but the slot ends remain separated by a distance approximately 1.5 to 1.7 times the width of each leg.

The side edges of the central portion are each centrally cut away in a generally semicircular pattern to form inwardly curved edges 18, 19. The distance between the closed ends of the slots 16, 17 and points on the curves 18, 19 nearest thereto is substantially equal to the width of the legs 12–15, i.e. not less than said width and not more than 5 or 10 percent greater than said width.

In a specific illustrative embodiment, using the above-identified metal plate, the over-all length of the element is 0.270 inch and the width is 0.142 inch. The legs are each 0.047 inch in width and the slots 16, 17 are 0.008 inch in width and 0.100 inch in length. The curved edges 18,.19 are semicircular with a radius of 0.026 inch. The length of the rectangular central portion is 0.100 inch.

The contact elements are enclosed within a body member formed of a top element 30 and a bottom element 40 in connected slot-like cavities 31, 41 provided for the purpose. Wire-accepting grooves 32, 33 and 42, 43 extending transversely of the body member are centered on the cavities and on the elements contained therein, as will be apparent from FIGS. 1 and 6. Grooves 34, 44 in the walls of the transverse grooves receive wire-cutting knife elements, not shown, which serve to remove unnecessary end portions of wires at the time connection is made to such wires by the contact elements.

The top and bottom elements 40, 30 of the body are further provided with central rows of cavities 35, 45, two opposing walls of each of said cavities being provided with narrow marginal ridges 36, 46 for a purpose to be described. The bottom element 30 has marginal edge channels 37, 38.

The two parts 30 and 40 of the body member, after insertion of the contact elements, are sealed together with the ridged surfaces outwardly as indicated in FIG. 6. Suitable indexing pegs and holes, not shown, may be provided on the flat inwardly facing surfaces of the two if desired, although the contact elements themselves assist in achieving proper alignment. The two parts are then preferably bonded permanently together. Wires may then be forced into opposing transverse grooves for interconnection, using base and cover members as illustrated in FIGS. 2 and 5.

The base 20 of FIG. 2 has a series of alternating long ridges 21 and short ridges 22 fitting within the grooves 32 and 33 respectively. Each said ridge is constricted, as at 24, in line with the slot 17 of the corresponding contact element. Pegs 25 and 26 define channels corresponding to wire-accepting grooves 32, 33 of FIG. 3 and lie along the edge channels 37, 38 respectively when the base is properly positioned against the body bottom member 30. Central long pegs 27 fit within cavities 35 of said member 30 with a force fit effected by the ridges 36 and hold the two members together as well as assisting to define the wire-receiving channels. Short pegs 28 similarly assist in defining the channels and act as spacer elements in the completed assembly. Widened ridge ends 29 fit against knife edges supported in grooves 34 of bottom 30.

Somewhat analogously, the cover 50 of FIG. 5 has long ridges 51 and short ridges 52, each with a constriction 54 in line with the corresponding contact element. Long pegs 57 fit within cavities 45 of top member 40 and are held by ridges 46; short pegs 58 serve as spacers. Widened ridge ends 59 fit against knife edges mounted in grooves 44 of top 40.

The method of making connection between wire-ends of two communications cables will be apparent from the foregoing description taken in conjunction with the disclosures of U.S. Pat. No. 3,708,779 (Ser. No. 91,781). The base 20 is held in the position indicated in FIG. 2 and individual wire-ends from one of the cables are laid transversely across it, one in each of the channels defined by the upraised pegs 25–28. The wire-ends are tautly held in position while the body assembly, consisting of bottom 30 and top 40 with embedded contact elements 10 and if desired with knife edges inserted as previously indicated, is fitted thereagainst. Appropriate wire-ends from the other of the two cables are then similarly laid in the transverse grooves of the exposed surface of the top 40, and the cover 50 is fitted thereagainst. Pressure applied against base and cover then forces the wires into the bifurcate ends of the contact elements, displacing the insulating coverings and making spring compression reserve contact with the wire. At the same time the free end portions of the wires are pressed against the knife edges and are cut off, and the long pegs 27, 57 are force fit into their respective socket cavities 35, 45. The resulting module is held securely together, and effective permanent connection is made between the several wire-pairs.

The connector module as herein described is found to be superior to those of U.S. Pat. No. 3,708,779 (Ser. No. 91,781) in a number of respects. As previously indicated, one major advantage is its reduced size, a reduction in cross-sectional dimensions from ½ × ¾ inch to ⅜ × ½ inch, or a volume reduction of approximately 50 percent, being typical. Along with size reduction there is obtained improvement in ability to accept wires of an increased range of sizes while at the same time improving the spring compression reserve feature of the contact. And these advantages are obtained with no sacrifice in dielectric strength or ability to resist flashover between adjacent contact elements, and with increased economy of manufacture due to the simplified structure of the contact element.

What is claimed is as follows:

1. A wire-connector having a substantially planar spring compression reserve contact element in an insulating body, wherein said element consists of a flat plate of spring metal having an extended-width central portion, parallel legs extending from one end of said central portion to form an upper bifurcate contact member, parallel legs extending from the opposite end of said central portion to form a lower bifurcate contact member, the central slots of said contact members extending into said central portion, the inner ends of said slots remaining separated by a distance approximately 1.5 to 1.7 times the width of each of said legs, the side edges of said central portion being centrally cut away in a generally semicircular pattern to form inwardly curved edges, the least distance between a said edge and a said inner end being substantially equal to the width of each of said legs thus providing a longer dielectric breakdown path between alternate contact elements.

2. Wire-connector of claim 1 wherein the dimensions of said contact element have approximately the following ratio:

| | |
|---|---|
| overall length | .270 |
| overall width | .142 |
| width of each leg | .047 |
| length of each leg | .085 |
| width of slot | .008 |
| length of slot | .100 |
| radius of curved edge | .026 |
| thickness of plate | .012 – .016. |

3. Wire-connector of claim 1 wherein said insulating body comprises interengaging elongate base and cover members and a body assembly comprising a transversely grooved bottom member, a correspondingly transversely grooved top member, and a said contact element inserted between said members and in line with said grooves for making contact with wires forced into said grooves and wherein said base includes elements defining a transverse channel in alignment with corresponding grooves of said body assembly.

4. Wire-connector of claim 3 wherein said body assembly includes a wire-cutting knife edge disposed across each of said transverse grooves in position for removal of an unwanted end portion of a wire laid therein.

* * * * *